United States Patent [19]

Marion et al.

[11] Patent Number: 4,693,376

[45] Date of Patent: Sep. 15, 1987

[54] APPARATUS FOR INSPECTING CONTAINERS

[75] Inventors: Paul R. Marion, Chicago; James J. Nemcoes, Orland Park; George C. Kolodziej, Oak Park, all of Ill.

[73] Assignee: National Can Corporation, Chicago, Ill.

[21] Appl. No.: 266,801

[22] Filed: May 26, 1981

[51] Int. Cl.[4] ..... B07C 5/34

[52] U.S. Cl. ..... 209/552; 209/587; 209/657; 250/223 B; 364/468; 364/575

[58] Field of Search ..... 209/587, 911, 657, 606, 209/642, 655, 576, 552, 522–524, 526; 250/223 R, 223 B; 356/240, 378, 428, 448, 394; 198/360; 193/31 A, 31 R, 29; 364/575, 468

[56] References Cited

U.S. PATENT DOCUMENTS

| | | | |
|---|---|---|---|
| 1,408,861 | 3/1922 | Burkart | 193/31 R |
| 2,742,151 | 4/1956 | Milford | 250/223 R |
| 2,781,477 | 2/1957 | Jenner, Jr. | 209/587 X |
| 4,017,194 | 4/1977 | Conroy et al. | 356/240 |
| 4,029,958 | 6/1977 | Wright | 209/587 X |
| 4,244,650 | 1/1981 | Garfunkel et al. | 250/223 B |

FOREIGN PATENT DOCUMENTS

| | | | |
|---|---|---|---|
| 703694 | 2/1954 | United Kingdom | 209/655 |

*Primary Examiner*—Robert B. Reeves
*Assistant Examiner*—Donald T. Hajec
*Attorney, Agent, or Firm*—Robert A. Stenzel; Ralph R. Rath

[57] ABSTRACT

A container inspection apparatus for inspecting coating integrity includes an electrical control system that produces an output signal representative of the reflectivity of an inner surface of the container which is fed to a microprocessor and is compared with lower and upper limit references. If the output signal is outside the limit references, an ejector mechanism located in a path for moving containers is activated to remove the defective container from the path. The ejector mechanism includes flipper rods pivoted at one end and located in an inclined portion of the path so that the defective containers are removed by gravity feed.

8 Claims, 4 Drawing Figures

FIG. 2
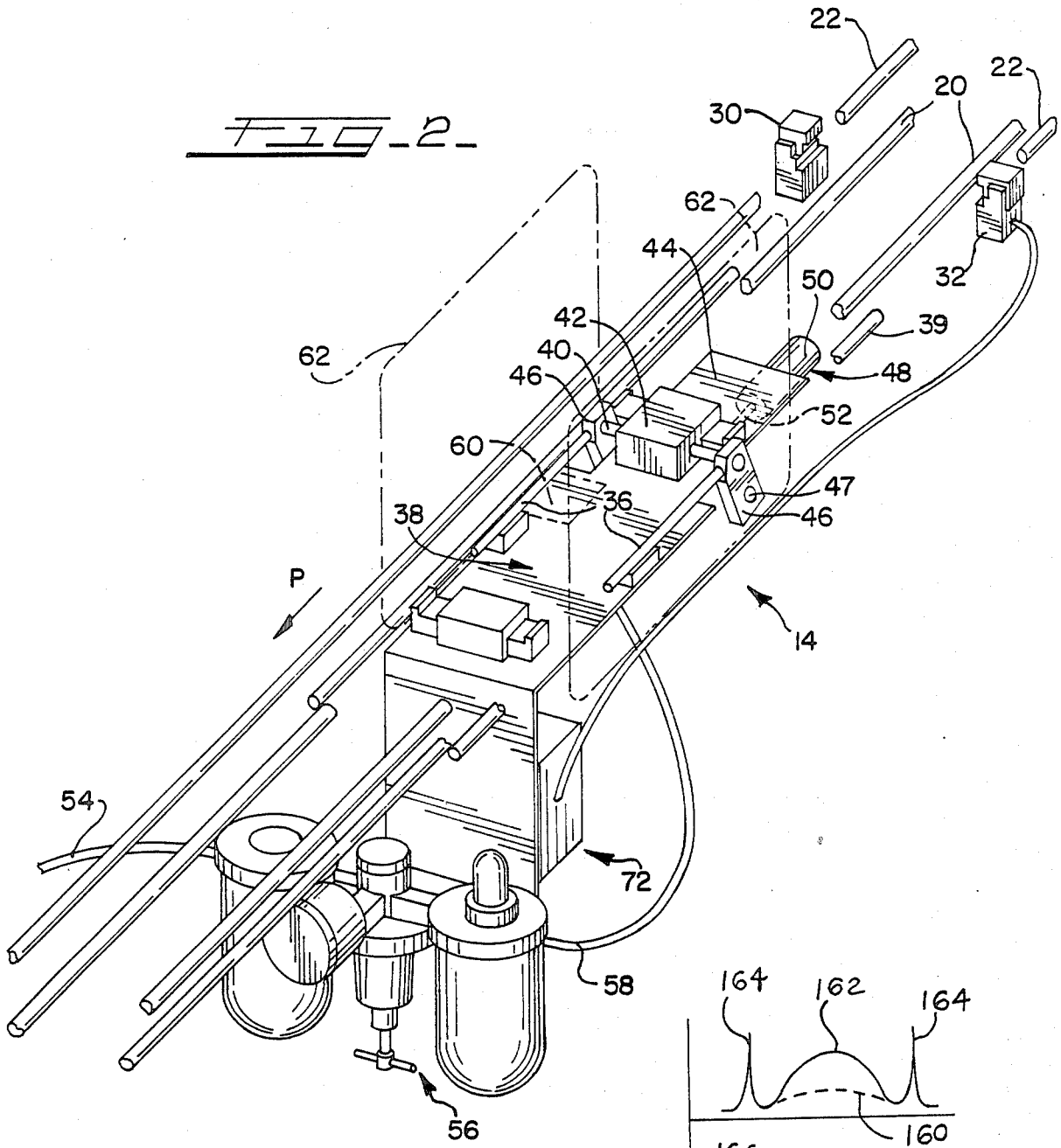
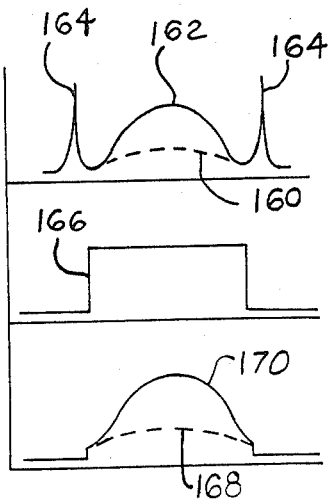
FIG. 4

APPARATUS FOR INSPECTING CONTAINERS

TECHNICAL FIELD

The present invention relates generally to container inspection apparatus and, more particularly, to an apparatus for inspecting coating integrity of containers and automatically rejecting any containers having defective coatings.

BACKGROUND PRIOR ART

In the manufacture of containers for packaging products such as beer or beverages, numerous steps are necessary to produce the finished container. The most common type of container for beer and beverages in existence today is what is know as a two-piece container wherein a blank is initially formed into a cup and then is reformed through a drawing and ironing process into a thinned sidewall having an integral end wall which is normally domed inwardly. The drawn and ironed container is then trimmed to a predetermined height, is cleaned in a can washer and a label is then applied. Next, a coating is applied to the inside surface, and finally it is given a reduced neck.

One of the essential steps in the can making process is the internal coating of the container which is crucial, particularly when a black plate material or tin plate material is utilized for the stock material. It is absolutely essential that the integrity of the internal coating be maintained to insure that no uncoated surface remains exposed which can be subjected to a corrosion process, particularly when carbonated beverages are stored therein, which may render the product unacceptable.

Numerous proposals have been made for automatically inspecting the integrity of a coating on the inner surface of the container, but these have been unsatisfactory and have never been commercially acceptable. Thus, most of the inspection still occurs utilizing the visual method or filling the container with a liquid material and taking a reading to determine the amount of iron, if any, present after a predetermined time span.

SUMMARY OF THE INVENTION

According to the present invention, a simplified commercially-acceptable means of inspecting the integrity of the internal coating of a drawn and ironed container has been developed which cooperates with a unique ejector mechanism so that any defective coated container will be ejected from the production line if the coating is not within prescribed limits.

More specifically, the present invention contemplates an electrical control system that automatically produces an output signal representative of the reflectivity of the inner surface of a container. This signal is fed to a microprocessor and is compared with lower and upper limit references.

The microprocessor produces a signal output whenever the reflectivity signal is beyond or outside prescribed limits, which in turn triggers an ejector mechanism to eject the defectively-coated container.

The ejector mechanism is of simplied construction requiring very little modifications of a conventional can processing line and utilizes gravity feed assisted by a flipper mechanism for automatically ejecting the container once a signal output is received from the microprocessor. In the specific embodiment illustrated, the ejection means includes an ejector member that is pivoted at one end about an axis transverse to the axis defined by the path of containers moving along a downwardly-inclined support surface. In the specific embodiment illustrated, the path for the moving containers is defined by a pair of spaced lower guide rails, a pair of side walls on opposite ends of the lower rails and a pair of top rails so that the containers must travel, by gravity, along a fixed path. A section of the lower and upper rails is removed to define a space into which the ejector mechanism is positioned with the ejector mechanism consisting of a pair of flipper rods that are aligned with the lower rails and supported on a pin at one end thereof. An actuating mechanism cooperates with the pin to pivot the rails upwardly and automatically cause a defective container to move out of the path.

BRIEF DESCRIPTION OF SEVERAL VIEWS OF DRAWINGS

FIG. 2 is an enlarged perspective view of the inspection and ejection area having the present invention incorporated therein;

FIG. 4 shows the waveform of a representative signal.

DETAILED DESCRIPTION

Figure 1:
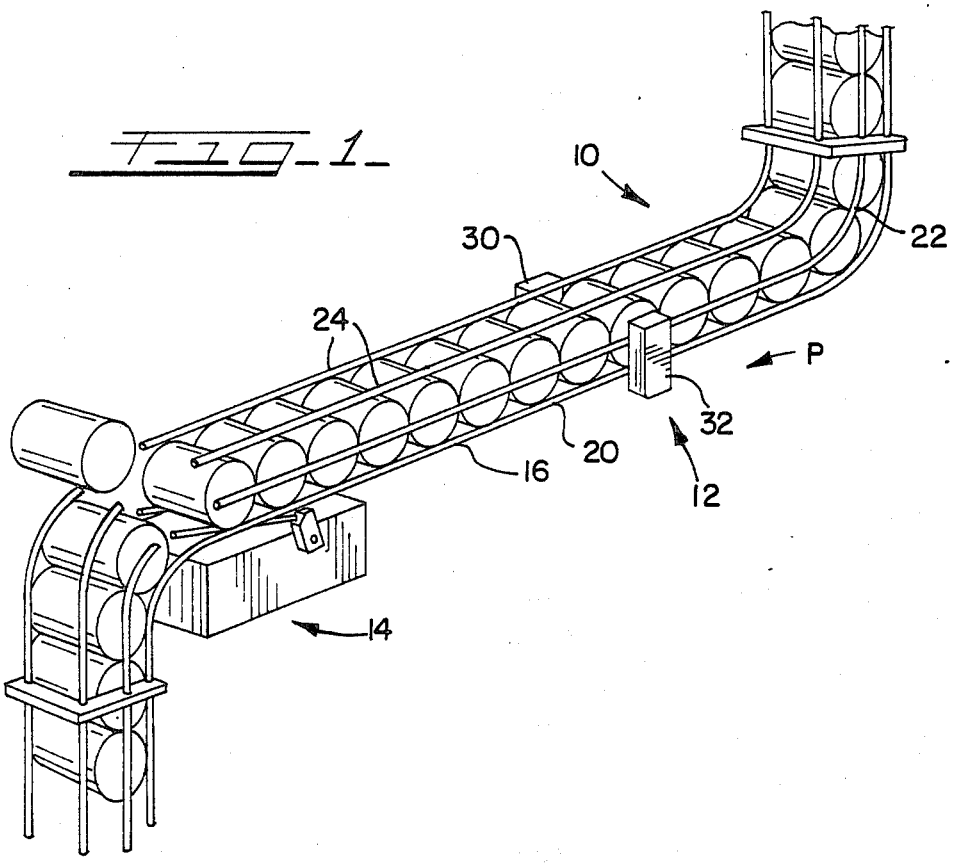
FIG. 1 is a schematic illustration of a portion of a can processing line having the present invention incorporated therein.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings generally discloses a portion of a can processing line, generally designated by a reference numeral 10, having an inspection apparatus generally designated by reference numeral 12, and an ejector mechanism 14.

As illustrated in FIG. 1, the inspection mechanism 12 and ejector mechanism 14 are located in a portion of the path which is inclined downwardly at an angle so that the containers are gravity-fed along the portion of the path where the inspection unit is located.

As illustrated in FIG. 1, the container processing line has an inclined portion 16. The path P (FIG. 2) for the moving containers is defined by a pair of lower guide rails 20, a pair of side rails 22 and a pair of top rails 24 so that the containers are essentially surrounded and are positioned with their axis generally horizontal. A pair of sensors 30 and 32 are respectively located on opposite sides of path P for the inspection operation, which will be described later. For every container encountered, the sensors 30 and 32 cooperate to produce a signal which is fed to a control mechanism, as will be described later.

The ejector mechanism 14 is more clearly shown in FIG. 2 and includes a pair of flipper rods 36 which are located in a space 38 that is defined by interrupting lower rails 20, as well as upper rails 24.

Guide rail extensions 39 are located in space 38 and are spaced apart a distance that is greater than the diameter of a container so that an upright container can fall through the space between extensions 39.

Flipper rods 36 have one end connected to a cross-pin 40 which is rotatably supported on a support block 42 supported on a platform 44. Pin 40 has a pair of arms 46 extending radially downwardly at opposite ends and a fluid ram 48 has its piston rod 52 connected to arms 46 by means of cross pin 47. Pressurized fluid, such as air, is supplied from a source through conduit 54 to an air filter, regulator and lubricator unit 56 and through line 58 to a four-way operated solenoid air valve 60 secured to platform 44. The air valve in turn is connected to opposite ends of the fluid ram 48 by conduits (not shown). Thus, extension of fluid ram 48 will pivot the flipper rods about an axis defined by pin 40 which extends transversely of the path P.

The ejector mechanism area is preferably surrounded by transparent plastic guards 62, which extend above upper rails 24 and act as a guide for defective containers.

Figure 3:
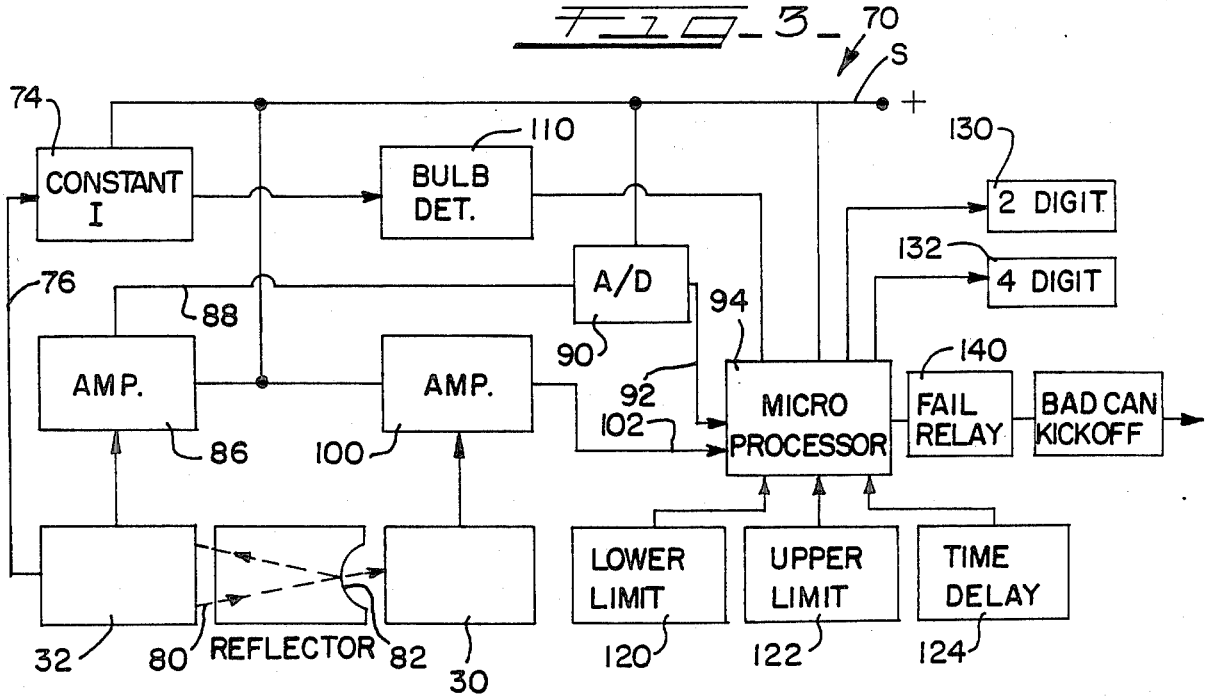
FIG. 3 is an electrical block diagram of the inspection apparatus.

The control circuit for activating the solenoid air valve is schematically illustrated in FIG. 3 and is generally designated by reference numeral 70 located in a control console designated by reference numeral 72 in FIG. 2. The sensing circuit includes sensors 30 and 32 which are located on opposite sides of the path. Sensor 32 has a constant current supplied thereto from a constant current source 74 through line 76. Sensor 32 is a retroreflective light sensor which produces a beam 80 that is directed towards a predetermined point within the container, such as the center of the dome 82, and monitors light which is emitted to the dome 82 and reflected off the inner surface of the test container. Sensor 30 receives the light beam 80 when there is no container located between the two sensors. Thus, when a container moves into the beam of light 80, the light beam is reflected back to the sensor 32 to produce an output signal. The output from sensor 32 is translated into voltage level and is fed to an amplifier 86 where the signal is amplified to a manageable level and is fed through line 88 to an analog-to-digital converter 90, of any suitable known design. The converter 90 converts the analog voltage level into an 8-bit binary form which is fed by line 92 to a microprocessor 94, of any suitable known type.

Sensor 30 monitors when a can is present for testing and produces a signal which is sent to an amplifier 100 where the signal is amplified to a manageable level in binary form of a logic-one or logic-zero. This output is fed through line 102 to the microprocessor 94. The control circuit also has a detector 110 which monitors the light output from the bulb in the sensor 32 which emits the light signal 80. The constant current source 74, the burned-out bulb detector 110, the analog-to-digital converter 90 and the microprocessor 94 all receive power from a common source S. This power supply may be in the form of a +5 volt power supply.

The microprocessor also receives a signal from a lower limit selector 120 and from upper limit selector 122, as well as a programmable time-delay selector 124, to be discussed.

A two-digit display 130 and a four-digit display 132 are also driven by the microprocessor 94. The two-digit display produces an indication of whether a test container has coating material on the surface or is completely uncoated, while the four-digit display indicates the amount of reflectivity from the inside of the container translated into a voltage level. For example, a properly coated container could produce a signal having a voltage ranging from 0 to 2 volts, while an uncoated container would produce a signal above the 2 volt level.

The microprocessor 94 is initially programmed to have a predetermined voltage level selected and includes four rotary switches which can be adjusted to produce an accurate lower limit. Likewise, the upper limit selector 122 includes four rotary switches which can be adjusted to set the upper voltage level. The time delay selector 124 is in the form of three rotary switches that can be adjusted to vary the time delay in millseconds that the system has for reactivating the microprocessor after a failure has occured to assure that a bad container is removed before a new can is tested.

Summarizing the operation, the sensor 32 produces a constant light beam or ray 80 which is directed toward sensor 30. When no container is present between the two sensors, sensor 30 produces a binary output signal received by the microprocessor 94 to indicate that no container is present for testing. When a container moves into the ray of light 80, the sensor 30 immediately produces a signal to microprocessor 94 to indicate a container is present and the light ray is reflected off the inner surface of the container back to the sensor 32 which produces an output signal representative of the condition of coating at the selected point on the container. This signal is fed through amplifier 86 and analog-to-digital coverter 90 to the microprocessor 94. The microprocessor then compares this digital signal with lower and upper limits set by switches 120 and 122. If the container coating signal is within the acceptable level, a digital display is shown on display 132 indicating the voltage level of the can being tested. Of course, since the containers are rapidly moving along the path in juxtaposed engaged relation, all of this occurs in a very short time span. In the event that the container being tested produces a reflective signal which is below or above the selected level set by the selectors 120 and 122, microprocessor 94 produces an output signal to relay 140. Relay 140 energizes a solenoid 142 forming part of solenoid-operated four-way valve 60 to pivot rails 36 or flippers upward and cause the defective container to be ejected from the path.

Preferably, the microprocessor computes a moving average of the values received to compensate for such slowly varying factors as ambient light intensity, changing metal reflectivity or contamination of the optics. In its preferred form, the microprocessor computes a moving average of the last sixteen values received, and this average value represents the average value for the previous sixteen acceptable containers. The next new value received representing the next container is compared with the moving average to determine whether this new value exceeds the moving average by some specified amount or percentage, such as one volt or 20% of the moving average. If this specified excess is present, the container is defective and the microprocessor activates the flipper to eject the container.

FIG. 4 illustrates an idealized waveform of light intensity reflected from a properly coated container, which is represented by dotted line 160, while solid line 162 represents a container which has a defective coating. The spikes 164 represents signal reflected from the bare metal of the container edge. These waveforms are modified by a synchronizing signal 166 and the ultimate waveforms received by microprocessor 94 are represented by lines 168 and 170.

As can be appreciated from the above description, the present invention provides a simplified version of an inspection apparatus that can easily be installed in any existing can line at almost any location with only minimum modification thereof.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out the invention, but that the invention will include all embodiments falling within the scope of the appended claims.

We claim:

1. An apparatus for inspecting the surface of articles in an article manufacturing line having an article surface processing station comprising an article presence sensing means for sensing the presence of an article at a selected location in said line; surface sensing means positioned adjacent said location for sensing the condition of at least a portion of the surface, said sensing of said portion of said article will indicate whether said article surface has been properly processed by providing signal means representative of the condition of said surface; computing means for determining a moving average value of said signal means from a preselected number of previously tested articles; comparing means receiving said signal means from articles being tested and also receiving said moving average value, said comparing means comparing said signal means received with said moving average value and providing a selected output when said signal means indicates an article having a value of a predetermined differences from said moving average value being tested, and means responsive to said selected output to determine the extent of further processing of said article in said manufacturing line.

2. Apparatus as defined in claim 1, in which said means responsive to said selected output includes flipper rods which are actuated in response to said selected output to eject articles having a predetermined difference.

3. Apparatus as defined in claim 2 wherein said flipper rods remain activated for a preselected period.

4. Apparatus as defined in claim 1, in which said surface sensing means includes an analog-to-digital converter converting the signal mean into digital format and said comparing means includes a microprocessor.

5. Apparatus as defined in claim 1, in which said comparing means includes means defining a range of satisfactory surface condition comprising selectors which define upper and lower limits for said range.

6. Apparatus as defined claim 1, in which said comparing means includes means defining an upper limit for said signal means and said means responsive to said selected output includes ejector means for ejecting an article when said signal means exceeds one of said upper limit and said moving average value.

7. Apparatus as defined in claim 6, in which said means responsive to said selected output includes flipper rods pivoted along said line adjacent said processing station.

8. Apparatus as defined in claim 1, wherein said selected output is produced when said signal means exceeds said moving average value by a predetermined percentage.

* * * * *